US005712445A

United States Patent [19]

Kassuelke et al.

[11] Patent Number: 5,712,445

[45] Date of Patent: Jan. 27, 1998

[54] PROPELLANT SYSTEM

[75] Inventors: Gregory T. Kassuelke, Maple Grove; Calvin T. Candland, Eden Prairie; James L. Kennedy, Bloomington, all of Minn.

[73] Assignee: Alliant Techsystems Inc., Hopkins, Minn.

[21] Appl. No.: 537,882

[22] Filed: Apr. 10, 1996

Related U.S. Application Data

[63] Continuation-in-part of Ser. No. 57,010, May 4, 1993, abandoned.

[51] Int. Cl.[6] ..... C06B 45/00; C06D 5/06

[52] U.S. Cl. ..... 102/288; 102/289

[58] Field of Search ..... 102/286, 288, 102/289

[56] References Cited

U.S. PATENT DOCUMENTS

| | | | |
|---|---|---|---|
| 1,920,075 | 7/1933 | Haenichen | 102/288 |
| 3,136,122 | 6/1964 | McJones | 60/39.47 |
| 3,165,060 | 1/1965 | Braun et al. | 102/98 |
| 3,166,896 | 1/1965 | Breitengross, Jr. et al. | 60/35.6 |
| 3,195,302 | 7/1965 | Hughes et al. | 60/35.6 |
| 3,217,651 | 11/1965 | Braun et al. | 102/98 |
| 3,316,842 | 5/1967 | Schulz | 102/100 |
| 3,396,661 | 8/1968 | Michael | 102/103 |
| 3,429,265 | 2/1969 | Longwell et al. | 102/100 |
| 3,677,010 | 7/1972 | Fink et al. | 60/220 |
| 3,706,278 | 12/1972 | Stiefel et al. | 102/38 |
| 3,811,380 | 5/1974 | Glass | 102/49.7 |
| 4,408,534 | 10/1983 | Araki et al. | 102/288 |
| 4,581,998 | 4/1986 | Horst, Jr. et al. | 102/289 |
| 4,615,270 | 10/1986 | Bell | 102/289 |
| 4,627,352 | 12/1986 | Brachert et al. | 102/290 |
| 4,714,019 | 12/1987 | Lips et al. | 102/307 |
| 4,722,814 | 2/1988 | Waehner et al. | 264/3.4 |
| 4,758,287 | 7/1988 | Pietz | 149/2 |
| 4,792,423 | 12/1988 | Craig et al. | 264/3.1 |
| 4,846,368 | 7/1989 | Goetz | 102/288 X |
| 4,876,962 | 10/1989 | Olsson | 102/288 |
| 5,000,885 | 3/1991 | Laird et al. | 264/3.1 |
| 5,101,730 | 4/1992 | Bender et al. | 102/288 |
| 5,345,873 | 9/1994 | Lauritzen et al. | 102/290 |
| 5,531,163 | 7/1996 | Dillehay et al. | 102/288 |
| 5,578,787 | 11/1996 | Kobari et al. | 11/288 |
| 5,610,365 | 3/1997 | Thiesen | 102/431 |

*Primary Examiner*—Peter A. Nelson
*Attorney, Agent, or Firm*—Haugen and Nikolai, P.A.

[57] ABSTRACT

A propellant load arrangement for a large caliber ammunition cartridge case accommodating a ballistic projectile includes a plurality of relatively flat shaped segments of propellant assembled face to face in an ordered arrangement. The faces of the segments of the arrangement are optionally parallel or perpendicular to the longitudinal axis of the cartridge case and essentially occupy the entire available propellant volume of the case. The outer peripheral geometry of each segment of the ordered arrangement is shaped to match the corresponding cartridge casing interior geometry and each segment of the ordered arrangement also has a shaped central interior recess opening as required of a geometry matching the corresponding geometry of any interfering internal cartridge part and any projectile geometry present. Relatively cool-burning segments can be combined with relatively hot-burning segments in stratified arrangements to provide a cooler boundary layer and reduce tube erosion.

22 Claims, 9 Drawing Sheets

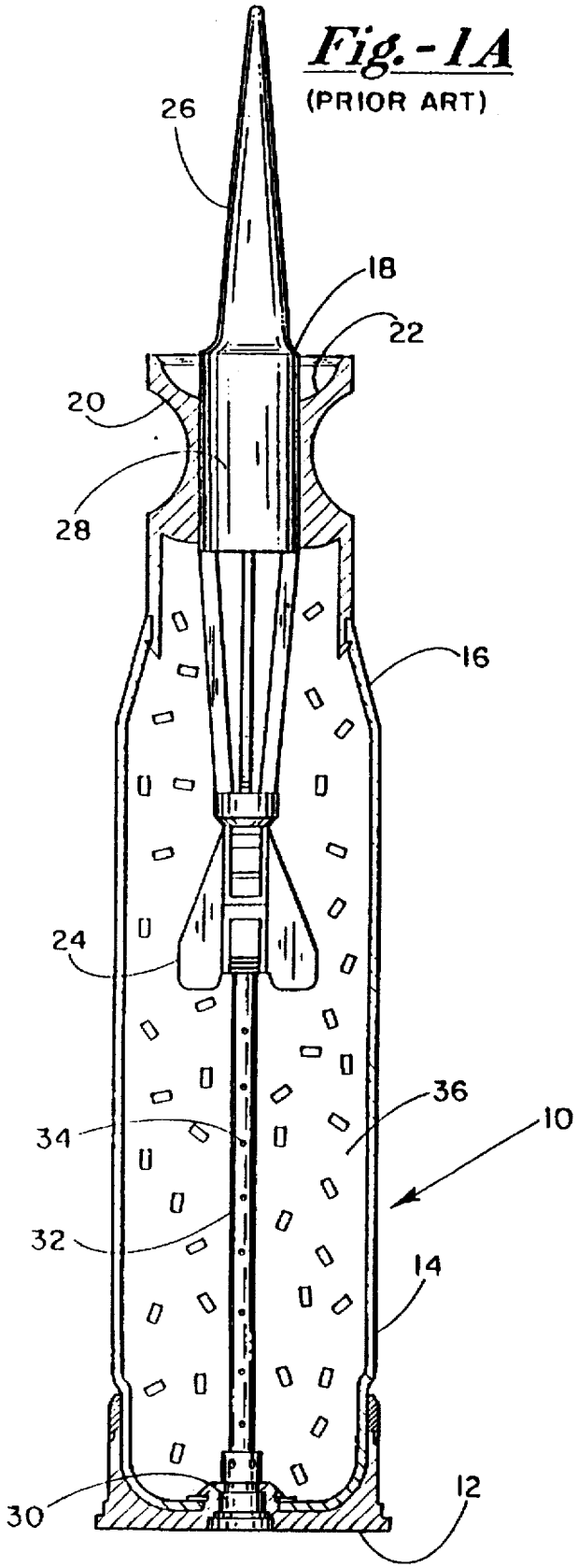
Fig.-1A
(PRIOR ART)
Fig.-1B
(PRIOR ART)
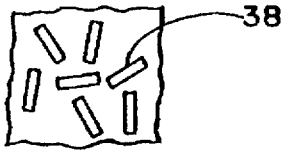

PROPELLANT SYSTEM

CROSS-REFERENCE TO RELATED APPLICATION

This application is a continuation-in-part of Ser. No. 08/057,010, filed May 4, 1993, now abandoned.

BACKGROUND OF THE INVENTION

I. Field of the Invention

The present invention is directed generally to the field of sophisticated, high velocity, large or medium caliber projectile ammunition and, more particularly, to an improved segmented propellant technique for loading such ammunition. The segmented propellant system of the invention may be in the form of an ordered series of shaped disks or slabs that yields highly efficient use of propellant load space, reduces loading labor and overall cost, yet uses highly accurate propellant geometry to produce better, more uniform burning progressivity and increase propellant load leading to improved repeatability and more reliable and improved ballistic performance. As a further advantage, axial or radial segmentation combining propellant segments of different burn heats or thermo-chemical values can be employed in the load to control burn temperature profiles to reduce cannon bore erosion.

II. Related Art

The evolution of large and medium caliber ordnance generally has led to the development of increasingly sophisticated projectiles and firing systems. The use of smaller diameter projectiles together with discarding sabots to transfer momentum and velocity to the projectiles has led to the development of very high velocity (Mach V+) and highly accurate munitions. These sophisticated munitions also may contain highly sensitive target proximity detection devices which operate precision arming and detonating circuits. This allows the warhead to be detonated at or close to the most proximate approach to the target. In addition to the electric control and sensing improvements, the construction of the rounds themselves has undergone an evolution that has produced vastly improved capabilities in terms of the lethality produced by a single round on a target.

Conventional ammunition of the class described, such as that fired by military tank cannons, are typically breech loaded from inside the tank and electrically activated and fired also from within the tank. The projectiles typically are electrically fired using a primer circuit which ignites a primer which, in turn, ignites a main propellant charge by DC voltage from a thermal battery activated by the primer. The projectile may contain electronics which utilize memory storage to operate a preprogrammed target acquisition or proximity system, and the arming and detonating devices in the shell during the flight of the shell. Then, it is apparent that large caliber ammunition, with respect to target acquisition, proximity detection, arming and detonating, has become very sophisticated. In addition, the projectiles themselves have become more aerodynamic and capable of traveling at speeds above Mach V.

While all these developments are interesting and important in the advancement of the art, the success of all ammunition projectiles still depends greatly upon the performance, the reproducibility of the performance of the associated propellant system. The effect of the hot explosive gases released by burning on the surface of the gun barrel is a further important consideration. A variety of techniques have been tried in order to improve ammunition muzzle velocity performance by increasing propellant charge density, i.e., increasing the amount of propellant per available cartridge volume unit. These techniques have included utilizing various preformed shapes packed into the cartridge in an effort to increase density while minimizing adverse effects on burning rate. Such techniques have included the use of various sizes of granular extruded (short grain) propellant shapes, perforated stick extruded shapes which are long and cylindrically shaped and represent the most commonly used shapes. Another configuration is in the form of a rolled sheet of propellant. Bulk liquid propellants have also been used; however, they tend to burn in a non-reproducible manner and, therefore, results have been unpredictable.

In addition to the granular extruded (short grain) prior configuration, compressed granular solid and perforated extruded shapes have been used. FIG. 1 depicts a typical large caliber round which may be fired from the main turret cannon of a tank or other such large caliber device loaded in accordance with the prior art. The round is shown generally at 10 at FIG. 1 and includes a base plate section 12 connected with the wall of a cartridge casing and having a generally cylindrical portion 14 and a necked down or tapered upper portion 16. The shell cartridge itself is normally made of metal or a combustible material such as molded nitrocellulose or other such material which is consumed during the firing of the shell. The projectile itself is shown at 18 with discarding sabot members 20 and 22 which peel away and drop off just after the projectile is discharged from the muzzle of the cannon. A plurality of stabilizing guidance fins as at 24 are also provided. The nose cone section 26 may contain an electronics package and the warhead section 28 may contain arming and detonating circuitry.

With respect to the firing of the shell, a primer housing shown generally at 30 contains a conductive ignition electrode or primer button (not shown). The primer housing is connected with a generally hollow brass or other type metal primer tube 32 which has a plurality of openings as at 34 which access and address the general propellant charge volume 36. As shown in the enlarged fragmentary view of FIG. 1B, the available propellant charge volume is filled with closely packed, generally uniformly shaped granular solid propellant grains 38 which may be 2 to 3 cm long by about 0.5 cm in diameter.

The shell is normally fired electrically using direct current to ignite the primer in the primer housing and through the primer tube 32, thereby igniting the main propellant 38 via the openings 34. In accordance with improving one aspect of performance, i.e., achieving the highest, repeatable muzzle velocity for the projectile, it is desirable that the propellant burn as rapidly and uniformly as possible. In accordance with another aspect of the invention, reducing barrel erosion associated with the erosive, high velocity hot combustion gases produced in the burn is also a goal. This is especially important with respect to higher burning efficiency configurations. A configuration of propellant which allows increased and more reproducible burning together with lower production and loading costs is very desirable. If such a configuration could also be characterized by reduced bore damage, this would clearly be an added improvement.

The best performance to date has been achieved using stick propellant. The extruded stick shape has increased shell velocities. However, each stick has to be notched or "kerf cut" in several places on the side to prevent overpressurization during the burn; and the stick propellant has also presented difficulties with respect to achieving high loading density (FIGS. 2A, 2B, 3). These factors make stick propellant more labor intensive than desired and difficult and costly to load in production.

With respect to processing, the propellant manufacturer making stick propellant must begin with carpet rolled propellant, dry it, age it, pre-cut it for extrusion, extrude it with perforations, cut it to length, blend each length to minimize lot to lot performance variation, and kerf cut each length of stick before the propellant may be used.

The loading process for a cartridge using stick propellant is also very labor intensive and performance is not optimum because of mating surfaces of the stick, as in the case of random placement with granular propellant. The method used to extrude both stick and granular propellant creates perforations during the process. This method places the perforations and web inconsistencies throughout the length of the granular shape which actually reduces the propellant performance.

In addition, repeatability of acceptable or good performance of stick propellant also requires uniformity of the notch or kerf size and web between the kerfs for proper burning. The current processes of extrusion and kerf cutting are rarely able to achieve this so that the sticks must be blended or mixed prior to loading to achieve some uniformity. As a result of mixing the stick propellant, performance is not optimized.

FIGS. 2A and 2B are partial sectional views to illustrate prior art loading geometries for propellant sticks for a shell 40 including a projectile 42 with stabilizing guidance fins 44. FIG. 3 is a further schematic drawing that illustrates a vertical crossection of a fragmentary view of a similar shell 50 containing projectile 52 with fins 54 and an ignition system as shown at 56. The loading of the cartridge 50 as can be seen from FIG. 3 requires at least eight different sizes or lengths of stick propellant and in large quantities. While perforated stick propellant provides configurations that yield high performance burns, as can readily be appreciated from the drawings, the loading of the shell also leaves considerable void space in the load. Perfect loading still leaves about 22% void space not counting perforations or kerf cuts.

Another method utilizing ribbed sheet propellant rolled into cylindrical sections has been tested on smaller caliber ammunition. This method used longitudinal ribs replacing perforations to assist ignition. The rolled method experienced difficulty in conformance to the projectile geometry, poor progressivity, poor flame spread and poor ignition characteristics.

Accordingly, it is a primary object of the present invention to produce a propellant loading which results in an increased charge load with a highly repeatable high burning rate achieved at a lower production cost.

Another object of the invention is to produce a propellant and loading system that burns in a manner that minimizes barrel surface or bore wear or erosion occasioned by high velocity, hot burning erosive propellant combustion gases.

A further object of the invention is to provide a sophisticated segmented propellant loading geometrically combining hot and cool burning components.

Yet another object of the invention is to provide a method of making a propellant which produces a highly accurate, repeatable geometry, thereby increasing load density and reducing loading time.

Other objects and advantages will appear to those skilled in the art in connection with the description of the invention.

SUMMARY OF THE INVENTION

The present invention solves many of the prior art problems associated with a munition propellant forming and loading by the provision of propellant segments in the form of disk or slab propellant shapes that yield more efficient use of propellant load space and achieve improved highly progressive burning and improved ballistic performance. The invention exceeds the superior burning performance qualities of the stick propellant at a reduced cost to produce, overall, a much improved propellant system. By comparison, in a typical 120 millimeter tank munition, the total available propellant load can be increased by at least twenty-five percent over a typical stick load for the same shell depending on whether round or hexagonal crossection sticks are used.

The disk or slab loading can be parallel or perpendicular to the longitudinal axis of the munition, depending on the technique used. Typically, the disk load includes a plurality of ordered, serially stacked, relatively flat sided disk-shaped segments arranged perpendicular to the longitudinal axis of the cartridge or shell casing, each disk member having a large number of relatively small diameter perforations arranged in a predetermined pattern in accordance with aiding burn progression. The outside periphery of each disk is designed to conform to the inside diameter geometry of the shell casing. A central opening is provided in each disk to accommodate the primer tube, if used, or to match the outer configuration of the projectile in the upper portion of the cartridge.

Aligned openings may be provided in the disks in the form of cutouts to accommodate one or more alignment rods, which may be ignition sticks. If desired, propellant spacers in the form of thin propellant rings may be interleaved between disks to adjust burn progressivity or performance.

With respect to the slabs, a plurality of stacked, substantially rectangular, longitudinally dispersed flat shapes or slabs are employed parallel to the longitudinal axis of the cartridge casing instead of the transversely disposed round disk shapes. These are also suitably shaped internally and externally and perforated and provided with interslab openings as required to produce the desired burn performance. The segments of propellant may vary in thickness from about 0.15 centimeters to about 2.54 centimeters as ballistics and propellant progressivity requires.

The segments can further be provided with perforations that are perpendicular or parallel to the faces of the disks or slabs. The segments can be of any desired web thickness and can be formed to give an acceptable high performance length to diameter ratio ensuring that the individual disk or slab burns at a highly progressive manner. The segments can also be formed with integral ribs or other types of precise spacing details where desired to maintain spacing and alignment between the segments and the perforations. Of course, all the segments are custom tailored to follow internal geometry changes throughout the cartridge both with respect to the outer cartridge shell and the internal workings and projectile geometry.

In accordance with the present invention, both the slab and disk geometry readily accommodate stratification of cool and hot burning propellant to thereby provide a boundary layer of predominantly cool-burning propellant combustion gases adjacent to the gun tube surface to reduce erosion. The disk propellant is axially stratified with hot burning disks generally aft or possibly interspersed with cooler burning ones. Slab shapes can be radially stratified by intermixing relatively hot burning slabs with relatively cool-burning slabs. The use of cool-burning outer or chord slabs is common with subvariations and combinations of propellant formulations used in inner slabs. Inner slabs may contain two propellant formulations as by using cooler-burning segments to flank a hotter-burning center segment.

Shapes are preferably fabricated from blended and rolled sheet propellent stock or from extruded bar stock. The fabrication process can be tailored to meet the requirements of the individual cartridge and performance requirements for maximum load, propellant load density and ballistic performance. The exterior geometry of the propellant is typically fabricated using a die set and press or a water jet cutter or a sawing process, matching the cartridge casing inside diameter. The interior geometry of the propellant is further fabricated using the same process matching the precise geometry of the primer tube or projectile and placing perforations into the disk or slab for burning and ballistic performance. Ribs or dimples, if used, can also be formed at the same time the propellant is pressed in the die. The water jet system can be programmed to process the propellant pieces for a full round in order. Scrap propellant can be reused.

BRIEF DESCRIPTION OF THE DRAWINGS

In the drawings, wherein like numerals are utilized to designate parts throughout the same:

FIG. 1A is a schematic view, partially in section, of a typical large caliber round of a class suitable for use with the propellant of the invention shown loaded with an extended granular shaped propellant of the prior art;

FIG. 1B is an enlarged fragment showing the propellant of FIG. 1A;

DETAILED DESCRIPTION

In accordance with the present invention, substantially higher propellant loading density is achieved in large caliber ammunition cartridges without sacrifice of burning performance. Protection of the internal bore surface may be enhanced by using stratified multi-formulation hot/cool arrangements. Not only does the propellant of the present invention enable a much denser packing of the cartridge and has been achieved with previous type loads, it uses a propellant form of lower cost because the shapes are easier to process and pack than rolled sheet propellant or perforated extruded stick propellant.

Figure 7:
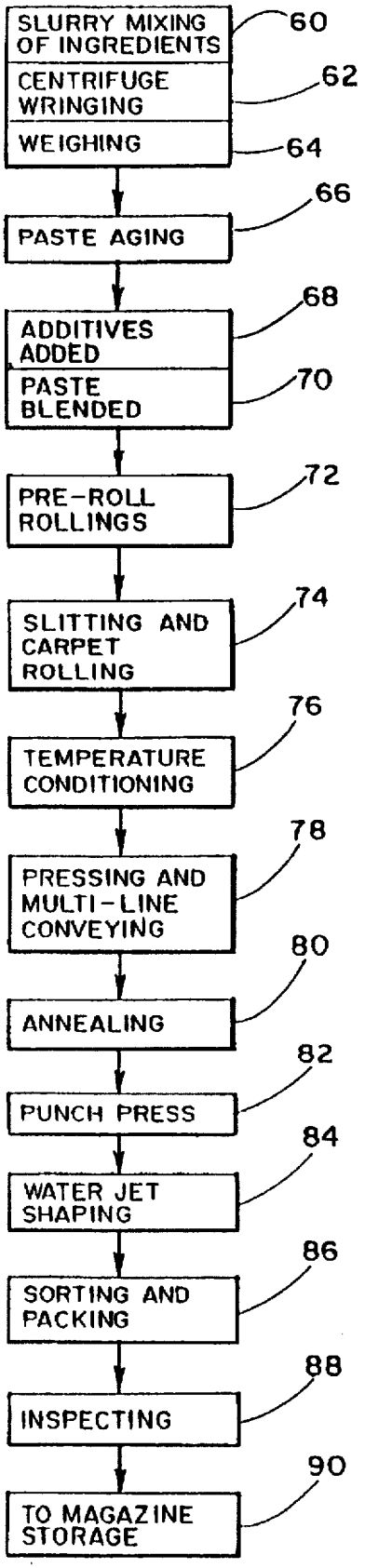
FIG. 7 is a process schematic illustrating steps utilized to make the segments of propellant in accordance with the invention.

The basic steps of the process for preparing the propellant are illustrated in a schematic blocked diagram of FIG. 7. The process may begin with the mixing of ingredients including one or more types of propellant such as Akardit II (2030.11) and then Akardit II (2001.6) (Hercules) nitroglycerin, DEGON, and other ingredients including those contained in relevant specifications or familiar to those skilled in the art, are mixed in a batching operation in a slurry tank as at 60 in FIG. 7. A relatively hot-burning M9 and a cooler-burning M30 (Hercules) may be employed, for example, in a stratified multi-formula configuration. After final mixing of the ingredients, the contents of the slurry tank are subjected to centrifuge wringing at 62 in a centrifuge wringer which, in turn, renders the mixture into a thick paste which is thereafter weighed as at 64. The paste is thereafter subjected to an aging step at 66 after which any desired additives such as graphite and magnesium oxide are blended into the paste mixture which may be provided with additional water, if necessary (68, 70). Thereafter, as shown at 72 and 74, the blended paste mixture is subjected to a series of rolling operations. The final operation normally utilizes a carpet roll to achieve the final thickness of approximately one-eighth inch (0.3 cm) to one inch (2.5 cm) thick followed by a slitting operation which yields sheets of propellant of a given thickness, width and length.

This is followed by a temperature conditioning step at 76, initial pressing 78 and an annealing operation 80 which yields straightened boards of relatively hard propellant material. This is followed by a punch-press operation in which the general shapes of the disks or slabs are formed from the straight boards of propellant. Thereafter, the punched disks or slabs are subjected to water jet final precise shaping at 84, including perforating, if perforations were not provided in the punch-press operation. The various configurations are then sorted and packed for shipment at 86 followed by an inspection step at 88 and thereafter transferred to magazine storage at 90 for later loading into the projectile cartridges. Sets of pieces or segments making up a full cartridge load may be processed stored together. Of course, the punch-press operation includes all the extrusion dies and other devices to produce the amounts of the various sizes and shapes required. A water jet operation can accomplish the finishing utilizing an automatic computer-controlled system. This geometry may be produced with such equipment as punch press, water jet, injection or transfer molding. Subsequent tailoring of the geometry may be processed by sawing, drilling, punching, cutting, or whatever process to which the propellant geometry readily lends itself.

Figure 2A:
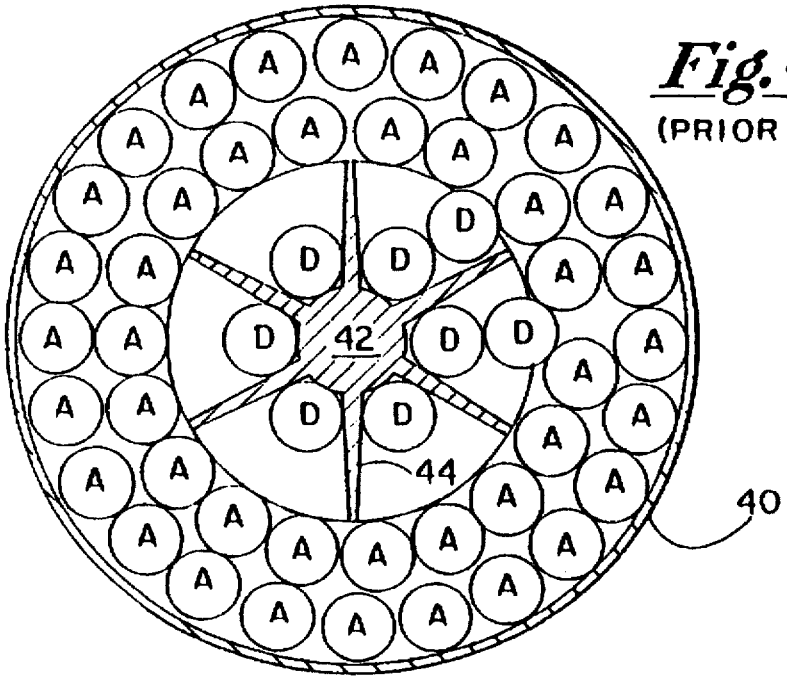
Fig.-2A (PRIOR ART)
FIGS. 2A and 2B represent sectional views through a large caliber cartridge illustrating prior art stick propellant configurations.
Figure 2B:
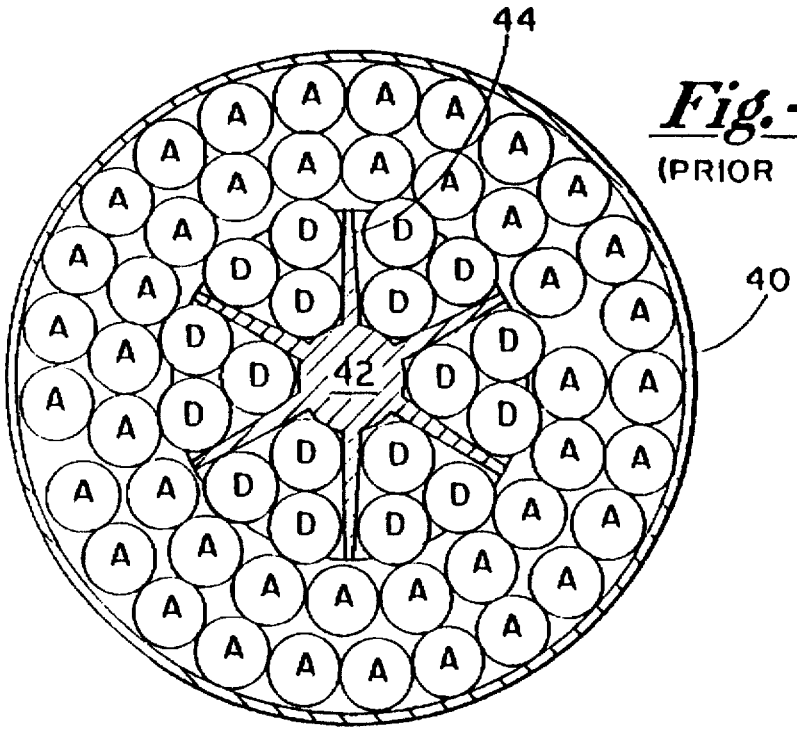
Fig.-2B (PRIOR ART)
Figure 3:
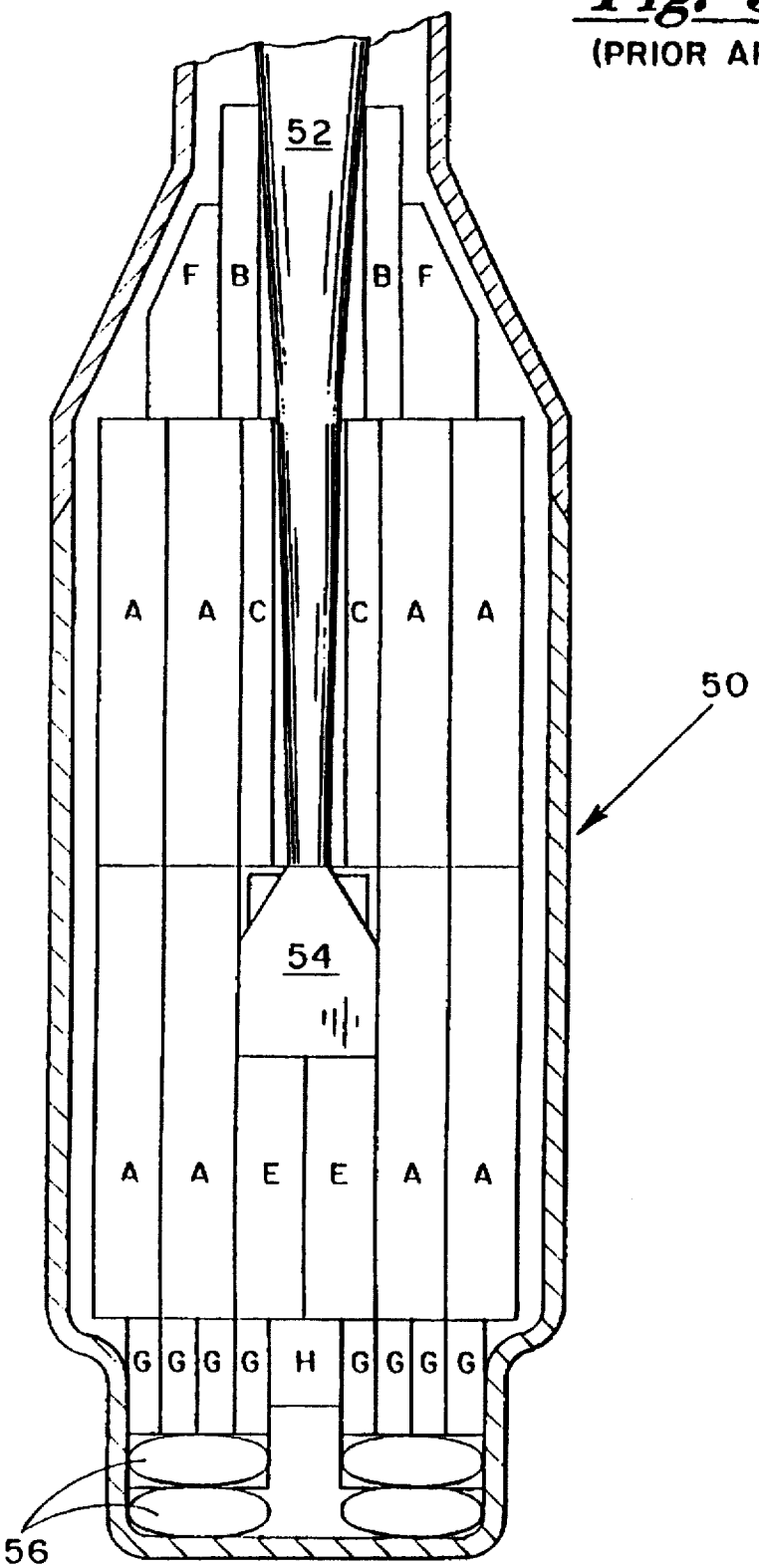
Fig.-3 (PRIOR ART)
FIG. 3 is a fragmentary, vertical view, partially in section, of another prior art large caliber munition utilizing perforated stick extruded propellant arrangement.
Figure 4A:
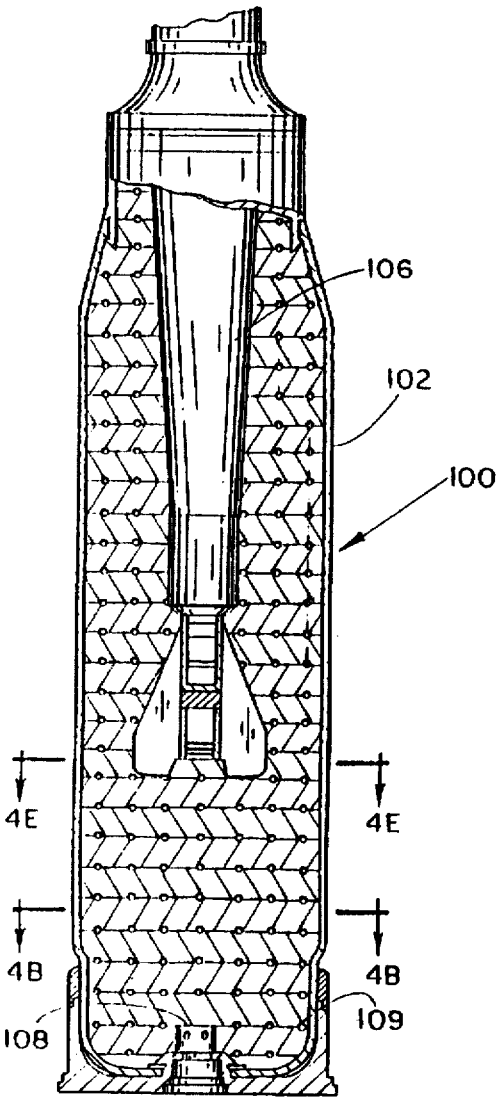
FIG. 4A depicts a fragmentary schematic view of a large caliber munition casing, partially in section, loaded with the stacked disk propellant according to the invention.
Figure 4B:
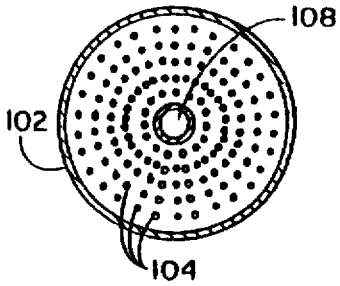
FIGS. 4B–4E show details of the load of FIG. 4A.
Figure 4C:
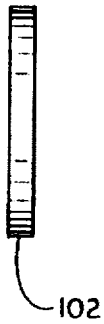
Figure 4D:
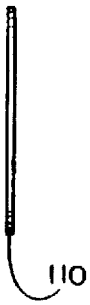
Figure 4E:
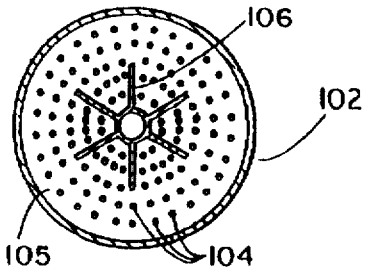

In this manner, precise disk or slab shapes can be produced complete with perforations, webs or any other intricacies as desired. The complete materials may be then shipped or moved to an area where the cartridges are actually assembled. As shown in FIG. 4A, a series of disks 102 can be stacked in a typical cartridge shell 100. As shown in FIGS. 4B and 4E, the disks 102 are provided with a perforations 104 and further have an exterior disk geometry that matches the cartridge case inside geometry 105 and an interior geometry custom tailored to accommodate projectile 106 as shown in FIG. 4E, and the metal primer tube 108 is illustrated in FIG. 4B. The disks 102 can be any desired thickness and typically vary from about 0.15 to 2.54 cm as ballistics and propellant progressivity requires. In addition, ring spacers such as that shown at 110 in FIG. 4D may be interleaved with the disks 102 to adjust the burn, if desired.

Figure 6A:
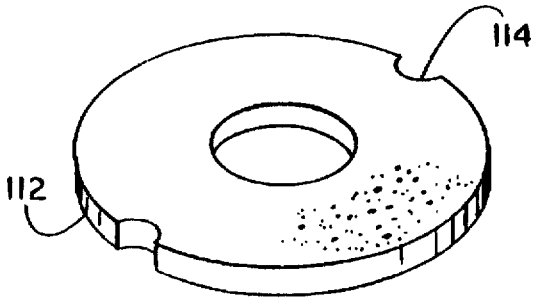
FIGS. 6A–6C depict an alternate stacking arrangement to that shown in FIG. 4A.
Figure 6B:
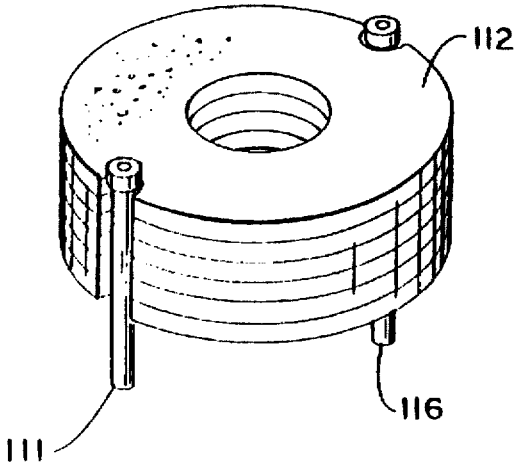
Figure 6C:
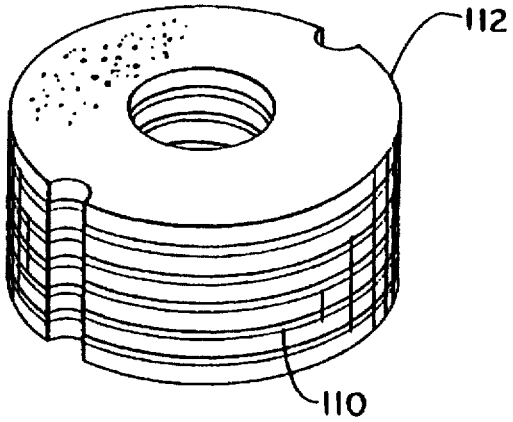

An alternative disk loading arrangement is depicted in FIGS. 6A and 6B in which disks 112 are provided with one or more notches or openings 114 which are used to align the disks and stick propellant as at 116 inserted in the aligned notches 114 to maintain the disposition of the disks 112. In addition, an optional spacer is illustrated at 110 in FIG. 6B. Of course, any of the disks can be relatively cool or hot burning material as desired in keeping with a particular design.

Figure 5A:
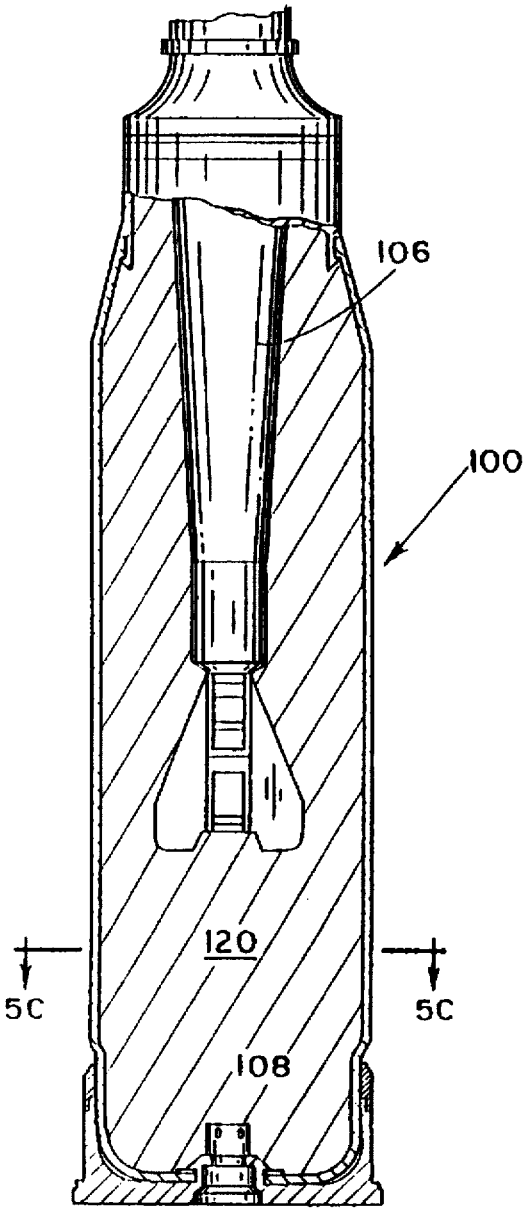
FIG. 5A is a view similar to that of FIG. 4A utilizing a longitudinal slab packing arrangement.
Figure 5B:
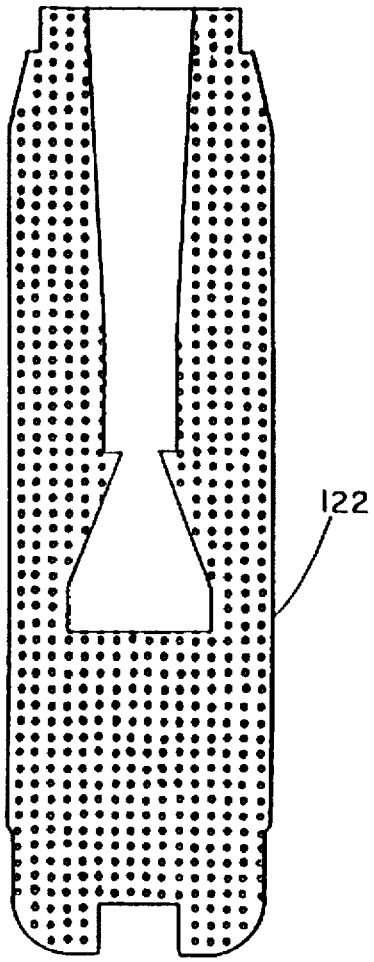
FIGS. 5B and 5C depict details with respect to the propellant of FIG. 5A.
Figure 5C:
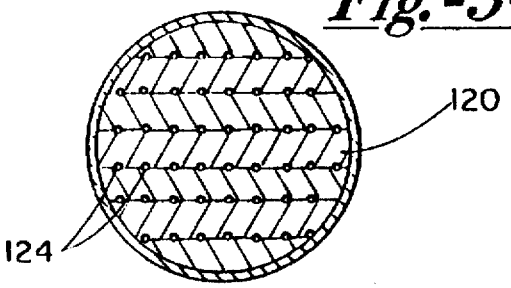

FIG. 5A depicts the shell of FIG. 4A loaded with propellant in the form of longitudinally disposed slabs 120 which in addition to the aligned axially or radially disposed perforations 122 illustrated in the rotated view of FIG. 5B, as seen in FIG. 5C, the slabs may be provided with a series of matching vertical recesses forming vertical perforations in the loaded propellant system as at 124. As was the case with the disk propellant illustrated in FIGS. 4A–4E and 6A–6C, the slabs 120 are custom tailored to precisely correspond to the anticipated interior geometry of the shell 100, the primer tube 108 and the projectile 106.

It will further be appreciated that the disk or slab propellant can be made by extrusion or transfer molding as well as rolling and, if desired, can be formed with ribs or other types of spacing details integral with the disks or slabs. Typically, the slabs or disks will also have perforations that further open areas between the layers as at 109 in FIG. 4A and 124 in FIG. 5C. These perforations can be produced by press and die punching or also by rolling or extrusion process. In this manner, when the disks or slabs are stacked, flame easily spreads between the layers in addition to through the stack. These processes will ensure accurate and repeatable control of web and perforation size and location than was formerly possible. Disks or slabs processed in the manner of the present invention will produce very progressive burning with high accuracy and repeatability. Disk or slab thickness can be formed to give an acceptable high perforation length to diameter ratio ensuring that the individual disk or slab burns with the progressive manner as desired.

Using a typical 120 mm cannon cartridge as an example (not limitation), it can be seen that loading propellant in accordance with the invention results in a tremendous increase in the amount of propellant available to fire the projectile. This can readily be translated into improved ammunition muzzle velocity and higher target accuracy. As previously stated, the typical 120 mm cartridge loaded with round stick contains 18 pounds of propellant, with hexagonally shaped grains 17 pounds, and utilizing a disk load in accordance with the present invention, this may be increased to 25 pounds which is definitely a significant improvement.

It has been found that the processing of the propellant in accordance with the present invention is lower cost than that associated with extruding stick propellant and thereafter notching or kerf cutting each of the sticks. The processing through the dies is efficient repeatable and accurate, and the additional processing using the water jet is fast, safe and it has been found that the devices can be programmed to cut out each of the different required disk or slab shapes for a complete round per program so that each section of processed disks or slabs will represent those needed to load a particular round of ammunition. With the batch mixing and rolling or extrusion process, propellant chemistry can be blended for maximum performance. In this manner, the complexity of the loading assembly is also minimized.

In addition, the firing performance of munitions made in this fashion has been found to be greatly improved. The numerous perforations in each disk and the uniform inter-disk or slab configurations allow for rapid flame spread, improving ignition. In addition, pressure waves associated with ignition can be controlled and the uniformity produced minimizes projectile structural damage or warping.

An important aspect of the invention deals with the reduction of gun barrel damage due to erosion associated with the friction of high velocity high temperature gases produced by the shell-firing process. The present invention further involves a technique that combines the use of hotter burning higher energy (i.e., higher flame temperature, more barrel-erosive gas-producing propellants) in combination with amounts of relatively cooler burning, less erosive materials in a manner that preserves advantages of increased overall propellant efficiency of the higher loading density disk or slab arrangement yet minimizes gun wear by confining the hottest propellant gases inside the fluid boundary layer toward the center of the chamber and gun tube, enabling the cooler propellant gases to wet the chamber and tube surface and form a protective boundary layer for the velocity profile in the barrel.

Figure 8:
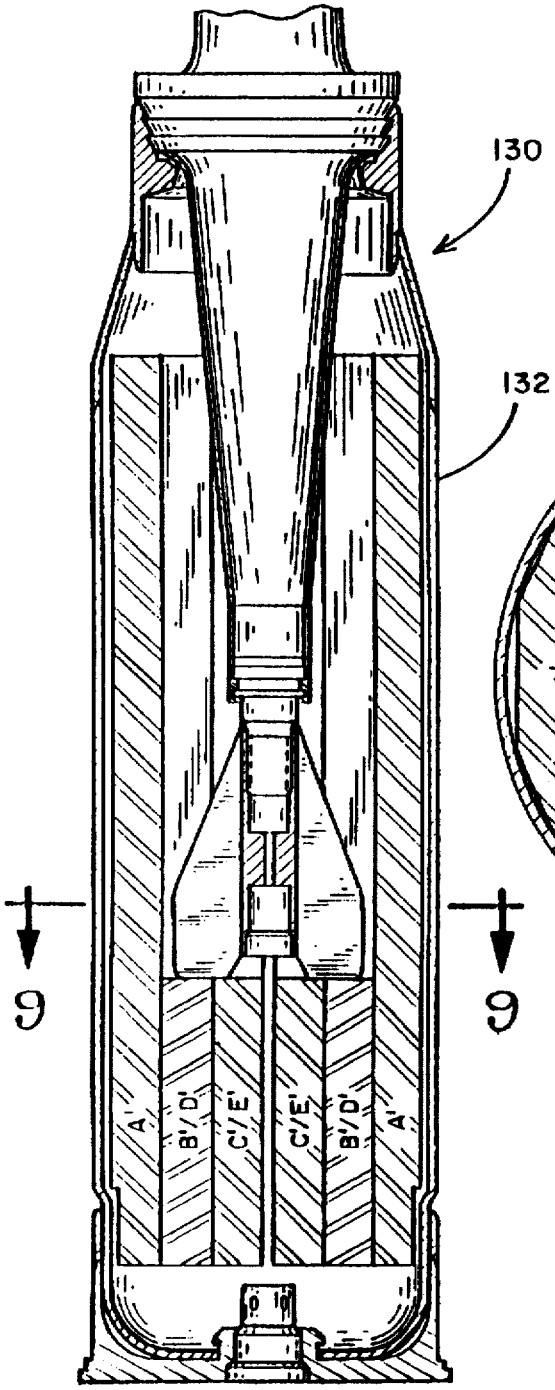
FIG. 8 is a fragmentary longitudinal or vertical assembly view partially in section of a large caliber munition depicting one possible arrangement of a multi-formulation slab arrangement.
Figure 10:
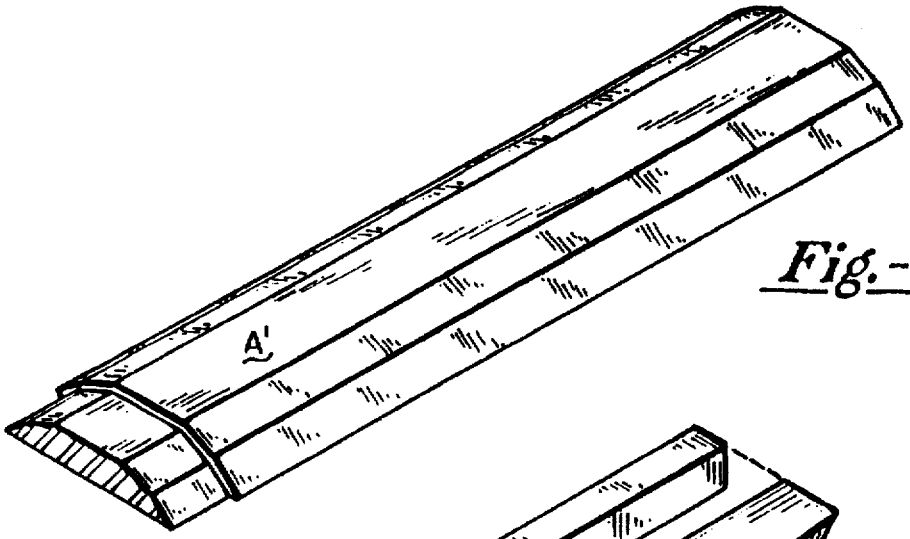
FIG. 10 is a detail in perspective of the geometric slab shape of the outermost chord-shaped slabs.

FIG. 8 is a longitudinal assembly view of a 120 mm cartridge 130 containing propellant slabs in radial stratification in which cool burning slabs and hot burning slabs are intermixed. The outer or chord slabs A' are formed from a relatively cool-burning formulation and have an outer geometry that generally conforms to the shape of the cartridge shell 132. The general geometry is further illustrated in the perspective view of FIG. 10.

Figure 9:
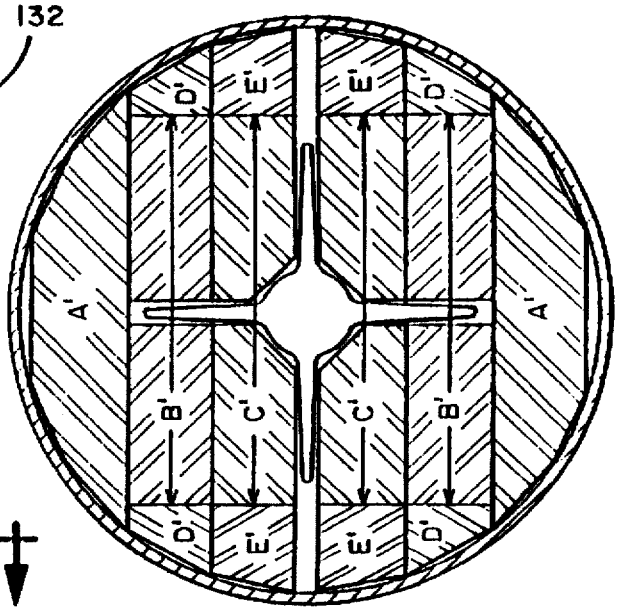
FIG. 9 is a radial cross-sectional view along line 9—9 of FIG. 8 showing a full multi-formulation stratified slab loading arrangement around the projectile fin blades.
Figure 11:
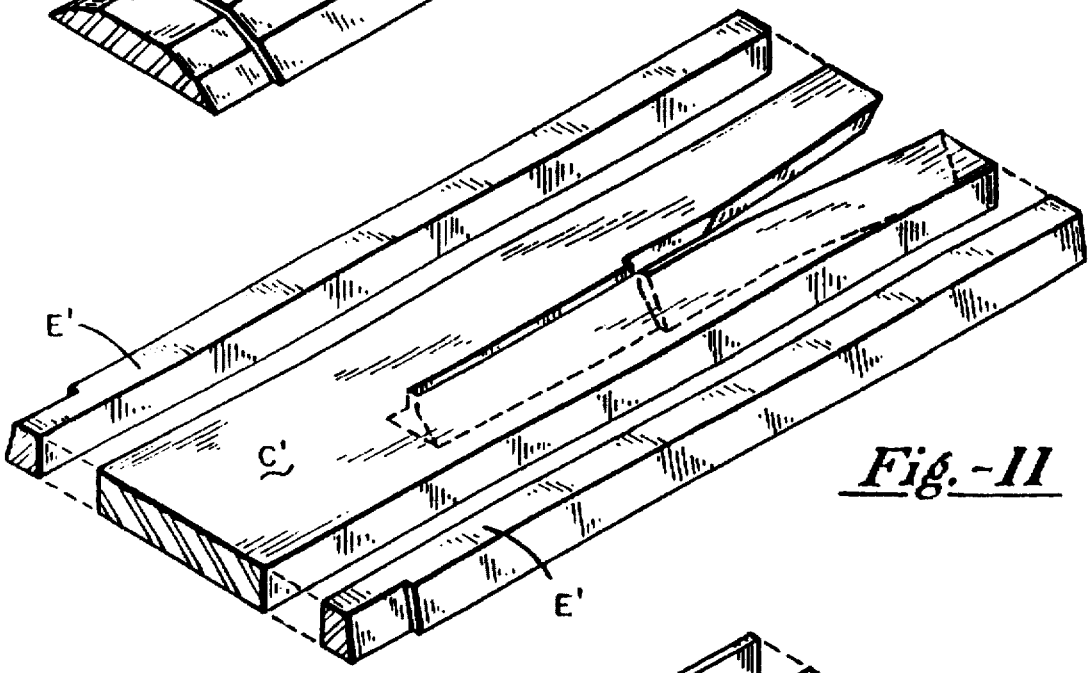
FIGS. 11 and 12 are exploded views of multi-component, dual-formula inner slabs.
Figure 12:
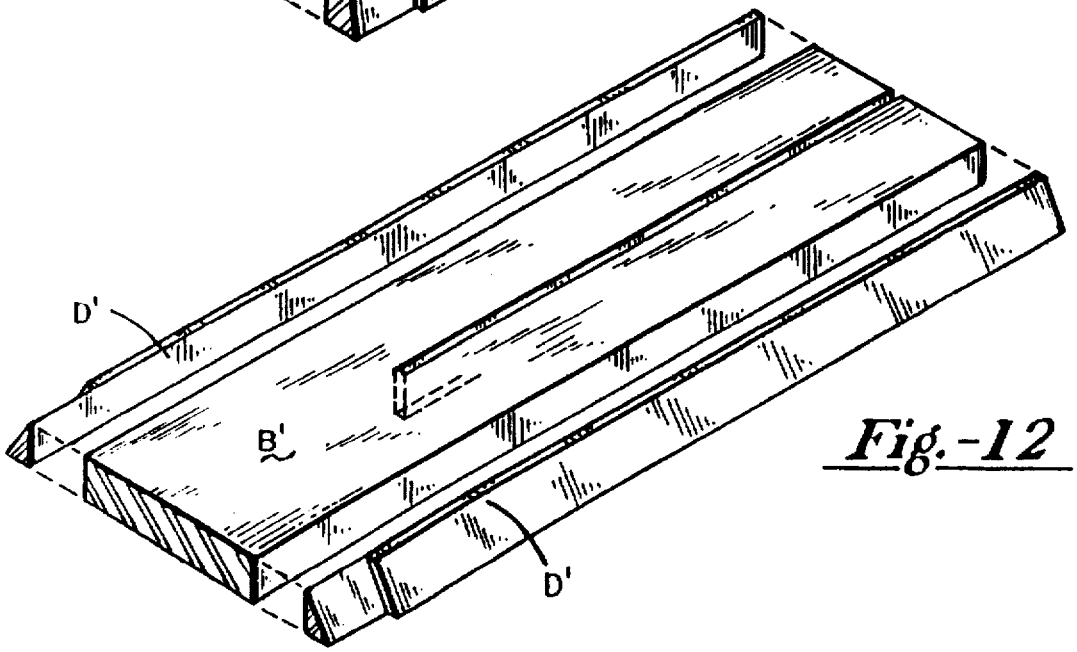

As shown best in the sectional view of FIG. 9, the inner slabs actually may comprise two propellant formulations. In this manner, the hot-burning slab segments B' and C' are respectively flanked by cool-burning segments D' and E'. This, in effect, enables the hot-burning segments B' and C' to be substantially surrounded by cool-burning segments A', D' and E'. The exploded perspective views of FIGS. 11 and 12 further illustrate details of the composite inner slab construction shapes contemplated.

The inner slabs may be extruded in both cool-burning and hot-burning propellant formulation versions. In one embodiment, these are then alternated within the cartridge yielding a cool-burning chord, hot slab, cool slab, hot slab, cool slab, cool chord configuration proceeding across the shell diameter. In another configuration, four inner hot-burning slab thicknesses are flanked by a pair of cool-burning chord slabs.

It will become apparent that both radial and axial stratification are possible with the multi-formula approach. In axial stratification, hot-burning propellant disks or slab portions can be located aft of cooler-burning segments or disks so that relatively cooler less erosive gases establish a protective boundary layer in the gun tube before the hotter, more erosive gases can reach the tube surface. Composite disks having outer rings of cooler-burning material than the central sections are also possible. The radial configuration allows the hotter-burning material to be partially or completely surrounded by the components of lower combustion or burning temperature.

The chord slabs and inner slabs or slab components for the composite inner slabs are preferably produced by extrusion;

however, any of the above processes can be employed. The relatively small number of slabs per shell make loading relatively simple and rapid. The hot-burning formula may be any compatible relatively high energy (thermochemical value) material such as M9 (Hercules) and the cool-burning formula, one such as M30 (Hercules).

It should further be appreciated by those skilled in the art that perforations, spacers and other techniques relating to controlling the burning progression throughout the load also apply to loads containing more than one propellant material as well. While the multi-burn rate loads have been described with relation to the use of two different thermochemical values, i.e., different adiabatic temperatures of combustion ($T_v$). This is done by way of illustration and not intended to exhaust or limit the number of possible materials and configurations envisioned as the number and complexity is readily modified. Generally, a hot-burning propellant is defined as one nominally generating a $T_v \geqq 3900°$ K. and a cool-burning propellant normally generating a $T_v \leqq 3100°$ K., for example, for applications in a 120 mm tank tube.

This invention has been described in this application in considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications can be accomplished without departing from the scope of the invention itself.

We claim:

1. A propellant load arrangement for a munition cartridge having a longitudinal axis and having an internal volume for accommodating a ballistic projectile and propellant material comprising:

(a) a plurality of relatively flat shaped slab segments of propellant material assembled face to face in an ordered arrangement, the faces of the segments of the arrangement being generally parallel to the longitudinal axis of the cartridge case and generally configured to occupy the available propellant volume of the cartridge; and (b) each of said slab segments of the ordered arrangement further having an outer peripheral geometry being generally shaped to accommodate the corresponding cartridge casing interior geometry and each of said slab segments of the ordered arrangement, where necessary, further having a shaped central interior recess opening of a geometry accommodating the corresponding geometry of any interfering internal cartridge element and any required projectile exterior geometry.

2. The propellant load arrangement of claim 1 further comprising means controlling burning progression throughout the propellant load.

3. The propellant load arrangement of claim 2 wherein the means for controlling burning progression throughout the load further comprises a plurality of patterned perforations of small diameter in each of the plurality of relatively flat shaped segments of propellant.

4. The propellant load arrangement of claim 1 wherein said plurality of relatively flat segments are in the form of relatively elongated slabs arranged generally in a stack comprising a plurality of inner slabs flanked by a pair of outer flanking slabs wherein said outer flanking slabs of the stack are fabricated of relatively cool-burning propellant material.

5. The propellant load arrangement of claim 3 wherein the means for controlling burning progression throughout the load further comprises small diameter perforations at adjacent surfaces between the shaped segments of propellant.

6. The propellant load arrangement of claim 1 wherein the propellant material comprises a plurality of propellant formulae including relatively hot and relatively cool burning material.

7. A method of providing propellant for a large caliber munition cartridge case accommodating a ballistic projectile comprising the steps of:

(a) providing an ordered series including a plurality of relatively flat slabs disposed face to face in an ordered arrangement, the faces of the slabs being generally parallel to the longitudinal axis of the cartridge case;

(b) shaping the outer peripheral geometry of each slab correspond to adjacent cartridge case interior surface geometry;

(c) providing and shaping a central interior opening as required in each serially ordered slab of a geometry similar to accommodate the corresponding geometry of any internal cartridge elements and the corresponding external geometry of the projectile; and (d) stacking the propellant slabs in the cartridge case in the ordered sequence.

8. The method of claim 7 further comprising the step of providing each slab with a plurality of pattern perforations therethrough.

9. A propellant load arrangement for a large caliber munition cartridge having a longitudinal axis and having an internal volume for accommodating a ballistic projectile and an amount of propellant material, said propellant material comprising:

(a) a plurality of relatively flat shaped slab segments of propellant material in juxtaposed alignment in an ordered arrangement, the faces of the segments of the arrangement being generally perpendicular to the longitudinal axis of the cartridge and configured to occupy the available propellant volume of the case;

(b) wherein the outer peripheral geometry of each segment of the ordered arrangement is generally shaped to accommodate the corresponding cartridge casing interior geometry and each segment of the ordered arrangement, where necessary, further having a shaped central interior recess opening, as required, of a geometry accommodating the corresponding geometry of any interfering internal cartridge element and any required projectile geometry; and (c) wherein the propellant material includes amounts of relatively hot-burning and relatively cool-burning propellant in stratified form.

10. The propellant load arrangement of claim 9 wherein said plurality of relatively flat segments are in the form of relatively elongated slabs arranged generally in a stack comprising a plurality of inner slabs flanked by a pair of outer slabs wherein said outer flanking slabs of the stack are fabricated of relatively cool-burning propellant material.

11. The propellant load arrangement of claim 10 wherein the inner slabs are alternately fabricated of relatively hot-burning and cool-burning propellant material.

12. The propellant load arrangement of claim 10 wherein the inner slabs are all fabricated of relatively hot-burning propellant material.

13. The propellant load arrangement of claim 10 wherein the inner slabs are of a composite construction comprising outer longitudinally disposed edges of relatively cool-burning propellant flanking a core portion of relatively hot-burning propellant.

14. The propellant load arrangement of claim 13 wherein the inner slabs comprise a plurality of segments of diverse burning temperatures.

15. The propellant load arrangement of claim 8 further comprising means controlling burning progression throughout the propellant load.

16. The propellant load arrangement of claim 15 wherein the means for controlling burning progression throughout the load further comprises a plurality of small diameter patterned perforations in each of the plurality of relatively flat shaped segments of propellant.

17. The propellant load arrangement of claim 16 wherein the means for controlling burning progression throughout the load further comprises separate spacing means between the segments.

18. The propellant load arrangement of claim 16 wherein the means for controlling burning progression throughout the load further comprises perforations between the shaped segments of propellant.

19. A propellant load arrangement for a munition cartridge having a longitudinal axis and having an internal volume for accommodating a ballistic projectile and propellant material comprising:

(a) a plurality of relatively flat shaped disk segments of propellant material assembled face to face in an ordered arrangement, the faces of the segments of the arrangement being generally perpendicular to the longitudinal axis of the cartridge case and generally configured to occupy the available propellant volume of the cartridge;

(b) each of said disk segments of the ordered arrangement further having an outer peripheral geometry being generally shaped to accommodate the corresponding cartridge casing interior geometry and each of said slab segments of the ordered arrangement, where necessary, further having a shaped central interior recess opening of a geometry accommodating the corresponding geometry of any interfering internal cartridge element and any required projectile exterior geometry; and (c) wherein each of said disk segments is provided with a dense pattern of perforations through the faces thereof for controlling burning progression.

20. The method of claim 7 wherein the slabs comprise a plurality of propellant formulae including relatively hot burning and relatively cooled burning slabs, the method further comprising the step of stacking said hot and said cool burning slabs in a predetermined arrangement in said cartridge case.

21. The propellant load arrangement of claim 19 wherein at least one of the disks is a composite of hot-burning material surrounded by cool-burning material.

22. The propellant load arrangement of claim 19 wherein the means for controlling burning progression throughout the load further comprises perforations at adjacent surfaces between the shaped segments of propellant.

* * * * *